US009224349B2

(12) United States Patent
Park

(10) Patent No.: US 9,224,349 B2
(45) Date of Patent: Dec. 29, 2015

(54) DISPLAY DEVICE AND DRIVING METHOD THEREOF

(71) Applicant: LG Display Co., Ltd., Seoul (KR)

(72) Inventor: Mangyu Park, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/569,938

(22) Filed: Dec. 15, 2014

(65) Prior Publication Data

US 2015/0187297 A1 Jul. 2, 2015

(30) Foreign Application Priority Data

Dec. 31, 2013 (KR) ..... 10-2013-0168639

(51) Int. Cl.
*G09G 3/36* (2006.01)
*G09G 5/18* (2006.01)

(52) U.S. Cl.
CPC ..... *G09G 3/3622* (2013.01); *G09G 3/3677* (2013.01); *G09G 5/18* (2013.01); *G09G 2310/067* (2013.01); *G09G 2310/08* (2013.01)

(58) Field of Classification Search
CPC ..... G09G 3/3611; G09G 3/3674; G09G 5/18; G09G 2310/08; G09G 2310/0267; G09G 2310/0281; G09G 2310/0286; G09G 2310/0289; G09G 2360/18; G09G 3/3208; G09G 3/36; G09G 2310/0213; G09G 2310/0278
See application file for complete search history.

(56) References Cited

U.S. PATENT DOCUMENTS 6,670,944 B1 12/2003 Ishii
7,924,258 B2 * 4/2011 O et al. ..... 345/100
2006/0038767 A1 * 2/2006 Nakamura et al. ..... 345/100
2007/0097057 A1 * 5/2007 Shin ..... 345/98
2008/0170024 A1 * 7/2008 Song et al. ..... 345/96
2009/0009497 A1 1/2009 Lee et al.
2009/0160845 A1 * 6/2009 Jang et al. ..... 345/214
2009/0225104 A1 * 9/2009 Hu et al. ..... 345/690
2009/0273555 A1 * 11/2009 Song et al. ..... 345/96
2011/0164076 A1 * 7/2011 Lee ..... 345/691
2012/0075279 A1 3/2012 Ishida
2012/0162054 A1 6/2012 Wang

FOREIGN PATENT DOCUMENTS

KR 20120032338 A 4/2012

OTHER PUBLICATIONS

Communication dated May 21, 2015 from the European Patent Office in counterpart European patent application No. 14199724.7.

* cited by examiner

*Primary Examiner* — Kent Chang
*Assistant Examiner* — Scott Au
(74) *Attorney, Agent, or Firm* — Morgan, Lewis & Bockius LLP

(57) ABSTRACT

A disclosed display device includes a display panel with data lines and gate lines, the gate lines including odd-numbered gate lines and even-numbered gate lines. The display device also includes a timing controller to generate a gate output enable signal, and a gate output enable signal division circuit to extract odd-numbered high logic periods of the gate output enable signal to output a first gate output enable signal and to extract even-numbered high logic periods of the gate output enable signal to output a second gate output enable signal. The display device further includes a gate driver to supply a first gate pulse to an odd-numbered gate line in response to the first gate output enable signal and a second gate pulse to an even-numbered gate line in response to the second output enable signal.

20 Claims, 7 Drawing Sheets

DISPLAY DEVICE AND DRIVING METHOD THEREOF

This application claims the priority benefit of Korean Patent Application No. 10-2013-0168639 filed in Korea on Dec. 31, 2013, which is incorporated herein by reference for all purposes as if fully set forth herein.

BACKGROUND OF THE INVENTION

1. Field of the Invention

The present invention relates to a display device and a driving method thereof.

2. Discussion of the Related Art

Display devices, which are delivery media of visual information, have been applied to various information devices or office machines. A cathode ray tube or a Braun tube, which is a widely available display device, has a problem that its weight and volume are great. Many kinds of flat panel displays capable of overcoming this limitation of the cathode ray tube have been developed, including a liquid crystal display (LCD), a field emission display (FED), a plasma display panel (PDP), an organic light emitting diode device (OLED), and the like.

In flat panel displays, data lines and scan lines are arranged orthogonally to each other, and pixels are arranged in a matrix form. In the LCD or OLED, the scan lines are also referred to as gate lines since gate electrodes of TFTs are connected to the scan lines. Video data voltages to be displayed are supplied to the data lines, and scan pulses (or gate pulses) are sequentially supplied to the scan lines. The video data voltages are supplied to pixels of the display lines to which the scan pulses are supplied. While all the display lines are sequentially scanned by scan pulses, video data are displayed.

Generally, a scan driving circuit for supplying the scan pulses to the scan lines of the flat panel display includes a plurality of scan integrated circuits (hereinafter, referred to as "ICs"). Since each of the scan ICs needs to sequentially output scan pulses, it includes a shift register. It may also include circuits and output buffers for controlling an output voltage of the shift register according to driving characteristics of a display panel. This scan driving circuit operates in response to control signals generated from a timing controller. Hereinafter, a scan driving circuit of a flat panel display will be described based on a scan driving circuit of an LCD.

FIG. 1 shows a related art gate IC of a scan driving circuit applied to an LCD. As shown in FIG. 1, the gate IC includes a shift register 10, a level shifter 12, and a plurality of logic AND gates 11 (hereinafter, referred to as "AND gates") connected between the shift register 10 and the level shifter 12.

The shift register 10 sequentially shifts gate start pulses GSP according to the gate shift clock GSC by using a plurality of dependently connected flip-flops. Each of the AND gates 11 performs an AND operation on the output signal of the respective flip-flop of the shift register 10 and an inverted gate output enable signal GOE to generate an output. The gate output enable signal GOE is inverted by an inverter 13, and input to one input terminal of the AND gates 11. The level shifter 12 shifts the swing width of the output voltage of the AND gate 11 to an extent at which a TFT of the LCD can operate. Output signals G1 to Gk of the shift register 12 are sequentially supplied to k (k is an integer) gate lines.

FIG. 2 shows related art examples of control signals for controlling a scan driving circuit and an output signal of the scan driving circuit. As shown in FIG. 2, a related art gate IC receives a gate start pulse GSP, a gate shift clock GSC, and a gate output enable signal GOE to output gate pulses G1 and G2 of one horizontal period (H), i.e., one cycle of the gate shift clock GSC.

The gate pulses G1 and G2 are for operating TFTs of a flat panel, in this example an LCD panel. In order to supply a voltage that can turn on the TFTs of the LCD panel, the width of a high logic period in the gate pulses G1 and G2 needs to be sufficiently long. In the related art device, as shown in FIG. 2, the TFTs can be operated even when the width of the gate pulses G1 and G2 is one horizontal period (H) as a horizontal period (H) tended to be relatively long. However, as the panels become larger and the resolution higher, one horizontal period (H) tends to become shorter. Therefore, when the width of the gate pulses G1 and G2 is set to one horizontal period (H), the TFTs may not be turned on or turned off at a desired timing.

In an effort to solve the above problem, a 'gate overlap' has been proposed in which the width of the high logic period of the gate start pulse GSP is increased to two horizontal periods (H) as show in FIG. 3.

However, when the gate start pulse GSP is input for two horizontal periods (H) as shown in FIG. 3, a 'gate off' phenomenon may occur in which the voltage level of the gate pulses G1 and G2 falls during the high logic period of the gate output enable signal GOE, thereby potentially causing a temporary cut-off period while source output data are to be transferred to pixels of the panel.

Moreover, when the high logic period of the gate pulses G1 and G2 is maintained for two horizontal periods (H) without the 'gate-off' phenomenon, the voltage charged in the pixels of the LCD panel is influenced by the data voltage of the previous frame during one horizontal period (H) while the gate pulses G1 and G2 overlap each other. Therefore, when the difference in data from the previous frame to the current frame is large, the charge rate of a source output waveform may fall.

SUMMARY OF THE INVENTION

Accordingly, the present invention is directed to a display device and a driving method thereof that substantially obviate one or more of the problems due to limitations and disadvantages of the related art.

An object of the present invention is to provide a display device capable of preventing the occurrence of a 'gate off phenomenon' and improving the charging characteristics of data voltages, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device includes: a display panel having a plurality of data lines and a plurality of gate lines crossing the data lines, the gate lines including a plurality of odd-numbered gate lines and a plurality of even-numbered gate lines; a timing controller to generate a gate output enable signal; a gate output enable signal division circuit to extract odd-numbered high logic periods of the gate output enable signal to output a first gate output enable signal and to extract even-numbered high logic periods of the gate output enable signal to output a second gate output enable signal; and a gate driver to supply a first gate pulse to at least one of the odd-numbered gate lines in response to the first gate output enable signal and a second gate pulse to at least one of the even-numbered gate lines in response to the second output enable signal.

In another aspect of the present invention, a display device includes: a display panel having a plurality of data lines and a plurality of gate lines crossing the data lines, the gate lines including a plurality of odd-numbered gate lines and a plurality of even-numbered gate lines; a timing controller to generate a gate output enable signal and a gate shift clock signal; a gate output enable signal division circuit to generate a first gate output enable signal and a second gate output enable signal based on the gate output enable signal; and a gate IC to supply a first gate pulse to at least one of the odd-numbered gate lines based on the first gate output enable signal and a second gate pulse to at least one of the even-numbered gate lines based on the second output enable signal, wherein at least one of the first and second gate pulses has a width longer than one cycle of the gate shift clock signal and shorter than two cycles of the gate shift clock signal.

In yet another aspect of the present invention, a method for driving a display device with a display panel having a plurality of data lines and a plurality of gate lines crossing the data lines, the gate lines including a plurality of odd-numbered gate lines and a plurality of even-numbered gate lines is disclosed, the method including: receiving a gate output enable signal; generating a first gate output enable signal and a second gate output enable signal based on the gate output enable signal, wherein the first and second gate output enable signals each have a lower frequency than the gate output enable signal; supplying a first gate pulse to at least one of the odd-numbered gate lines based on the first gate output enable signal; and supplying a second gate pulse to at least one of the even-numbered gate lines based on the second gate output enable signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings. Wherever possible, the same reference numbers will be used throughout the drawings to refer to the same or like parts.

The present invention may be similarly applied to a number of different display devices, such as a liquid crystal display (LCD), a field emission display (FED), a plasma display panel (PDP), and organic light emitting diode device (OLED). The below detailed description is based on an example embodiment of the liquid crystal display.

Figure 1:
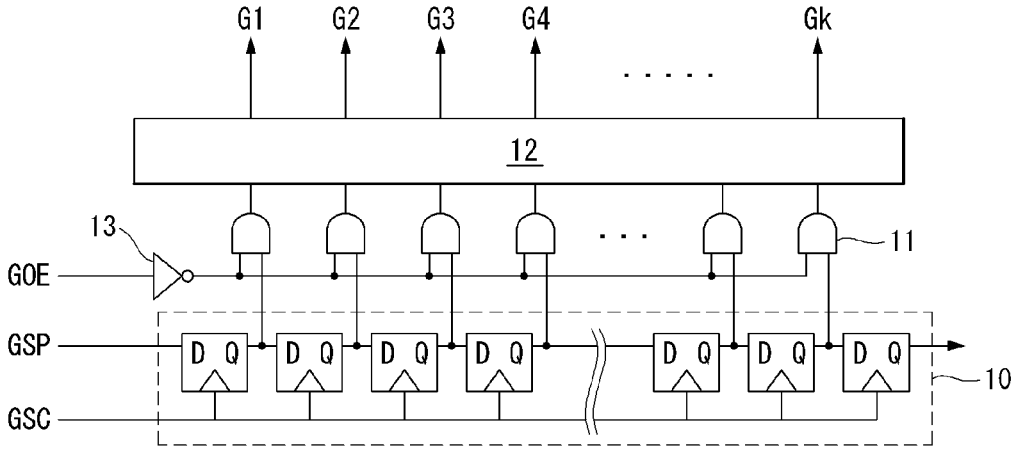
Fig. 1 RELATED ART
FIG. 1 is a circuit diagram showing an example of a gate IC according to the related art.
Figure 2:
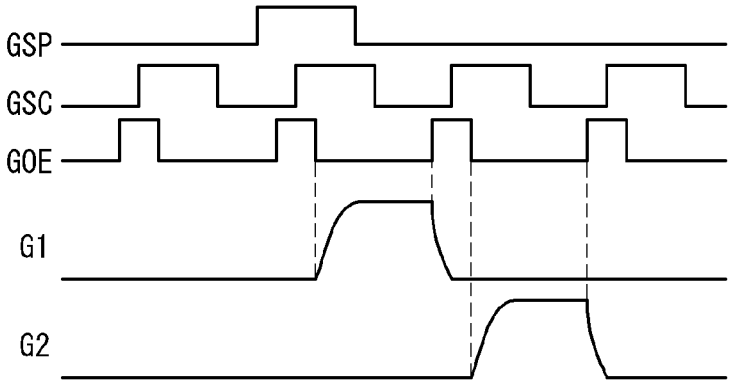
Fig. 2 RELATED ART
FIGS. 2 and 3 are waveform diagrams showing gate control signals and gate pulses according to the related art.
Figure 3:
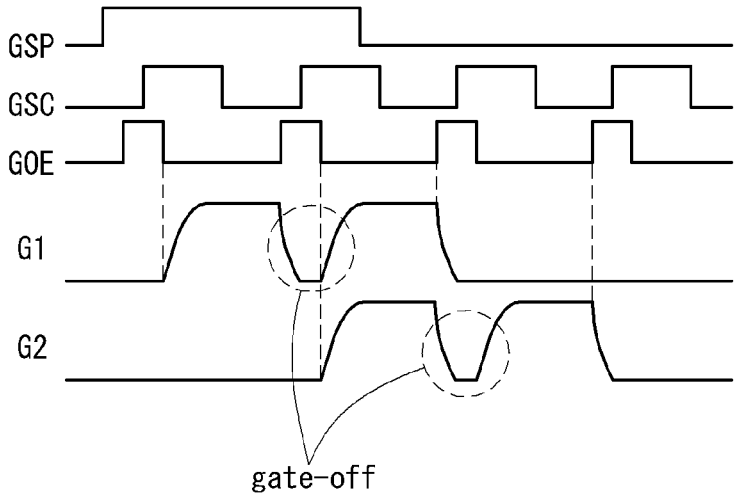
Fig. 3 RELATED ART
Figure 4:
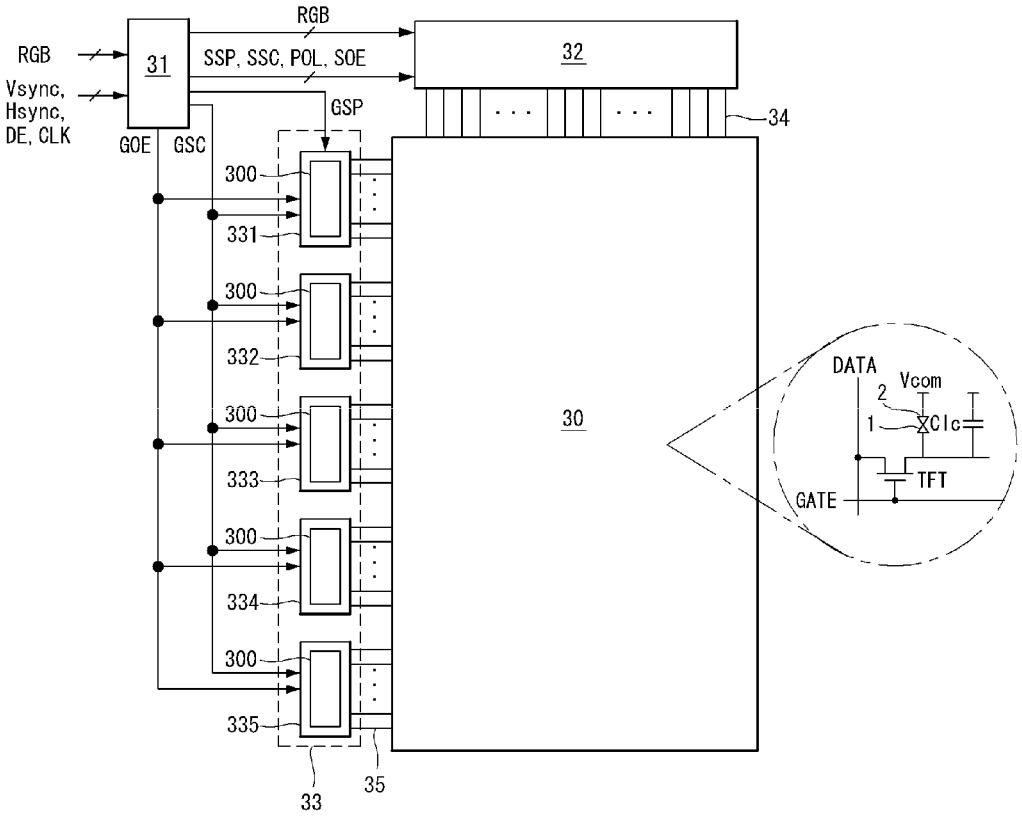
FIG. 4 is a diagram showing a liquid crystal display according to the first example embodiment of the present invention.

FIG. 4 is a diagram showing a liquid crystal display according to an example embodiment of the present invention.

As shown in FIG. 4, the liquid crystal display according to an example embodiment of the present invention includes a liquid crystal display panel 30, a timing controller 31, a data driving circuit 32, and a scan driving circuit 33. The data driving circuit 32 may include one or more source ICs. The scan driving circuit 33 may include one or more gate ICs 331 to 335. Although FIG. 4 illustrates an example where gate ICs are on one side of the display, the display may include gate ICs on both sides of the display. As yet another alternative example, the display may include gate drivers on one or both sides of a display panel substrate without the use of gate ICs.

In the liquid crystal display panel 30, a liquid crystal layer is formed between two substrates. The liquid crystal display panel 30 includes m×n liquid crystal cells Clc arranged in a matrix format at or near the crossings of m data lines 34 and n gate lines 35, where 'm' and 'n' are integers.

The data lines 34, the gate lines 35, TFTs, and storage capacitors Cst are formed on a lower substrate of the liquid crystal display panel 30. The liquid crystal cells Clc are connected to the TFTs, and are driven by an electric field between pixel electrodes 1 and a common electrode 2. A black matrix (not shown) and color filters (not shown) may be formed on an upper substrate of the liquid crystal display panel 30. Alternatively, color filters (not shown) may be formed on an upper substrate without a separate black matrix. The common electrode 2 may be formed on the upper substrate in a device employing a vertical electric field driving mode, such as twisted nematic (TN) mode and a vertical alignment (VA) mode. Alternatively, the common electrode 2 may be formed along with the pixel electrode 1 on the lower substrate in a device employing a horizontal electric field driving mode, such as an in-plane field switching (IPS) mode or a fringe field switching (FFS) mode. A polarizer (not shown) may be attached to each of the upper substrate and the lower substrate of the liquid crystal panel 30. An alignment film (not shown) for setting a pre-tilt angle of liquid crystals may also be formed on one or both of the substrates at an interface in contact with the liquid crystals.

The timing controller 31 may receive timing signals, such as vertical and horizontal synchronization signals Vsync and Hsync, a data enable signal DE, and a clock signal CLK to generate control signals for controlling operation timings of the data driving circuit 32 and the scan driving circuit 33. These control signals may include a gate timing control signal and a data timing control signal. In addition, the timing controller 31 may supply digital video data (RGB) to the data driving circuit 32.

The gate timing control signal generated by the timing controller 31 may include a gate start pulse GSP, a gate shift clock signal GSC, and a gate output enable signal GOE.

The gate start pulse GSP is applied to the first gate IC 331 to indicate a start line from which the scanning starts so that a first gate pulse is generated from the first gate IC 331.

The gate shift clock signal GSC is a clock signal for shifting the gate start pulse GSP. Shift registers of the gate ICs 331 to 335 shift the gate start pulse GSP at a rising edge of the gate shift clock signal GSC. Each of the second to fifth gate ICs 332 to 335 receives a carry signal from the previous gate IC as a gate start pulse GSP to generate a first gate pulse. Although this example embodiment uses five gate ICs, a different number of gate ICs may be employed.

The gate output enable signal GOE is commonly input to the gate ICs 331 to 335. The gate ICs 331 to 335 output the gate pulses during a low logic period of the gate output enable signal GOE, i.e., during a period between the falling edge of the previous pulse and the rising edge of the next pulse. During a high logic period of the gate output enable signal GOE, the outputs of the gate ICs 331 to 335 are cut off.

The data timing control signals generated by the timing controller 31 may include such signals as a source start pulse SSP, a source sampling clock SSC, a polarity control signal POL, and a source output enable signal SOE. The source start pulse SSP indicates a start pixel in a line on which data are to be displayed. The source sampling clock SSC indicates a latching operation of data in the data driving circuit 32 based on a rising or falling edge. The polarity control signal POL controls the polarity of an analog video data voltage output from the data driving circuit 32. The source output enable signal SOE controls outputs of the source ICs.

Each of the source ICs of the data driving circuit 32 may include a shift register (not shown), a latch circuit (not shown), a digital-to-analog converter (not shown), and an output buffer (not shown). The data driving circuit 32 latches digital video data RGB under the control of the timing controller 31. In addition, the source ICs of the data driving circuit 32 supply charge share voltages to the data lines 34 in response to the source output enable signal SOE, convert the digital video data RGB into a positive or negative analog gamma compensation voltages in response to the polarity control signal POL to generate positive or negative analog data voltages, and then supply the data voltages to the data lines 34.

Each of the gate ICs 331 to 335 according to an example embodiment of the present invention outputs first and second gate pulses G_O and G_E for driving odd-numbered gate lines and even-numbered gate lines, respectively. Each of the gate ICs 331 to 335 includes a gate output enable division part (hereinafter, GOE division part) 300 for dividing the gate output enable signal GOE received from the timing controller 31 into first and second gate output enable signals GOE_O and GOE_E. The GOE division part 300 outputs the odd-numbered high logic periods of the gate output enable signal GOE as a first gate output enable signal GOE_O, and outputs even-numbered high logic periods of the gate output enable signal GOE as a second gate output enable signal GOE_E.

Figure 5:
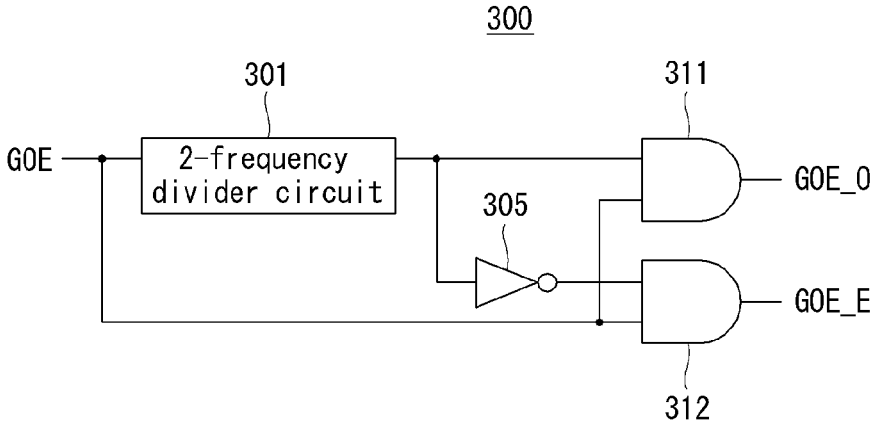
FIG. 5 is a circuit diagram showing a gate output enable signal division part according to an example embodiment of the present invention.
Figure 6:
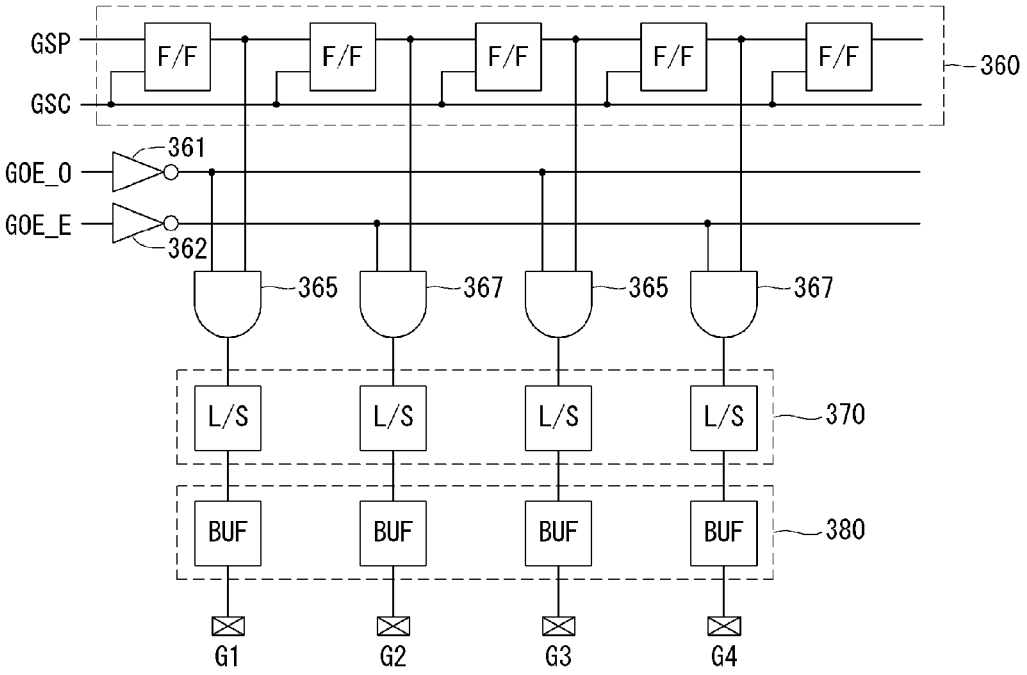
FIG. 6 is a circuit diagram showing an example of a gate IC according to an example embodiment of the present invention.

FIG. 5 shows an example of the GOE division part 300 for outputting the first and second gate output enable signals according to an example embodiment of the present invention. FIG. 6 shows an example gate IC including the example GOE division part 300 shown in FIG. 5, and FIG. 7 shows examples of the first and second gate pulses G_O and G_E output by the gate IC.

Figure 7:
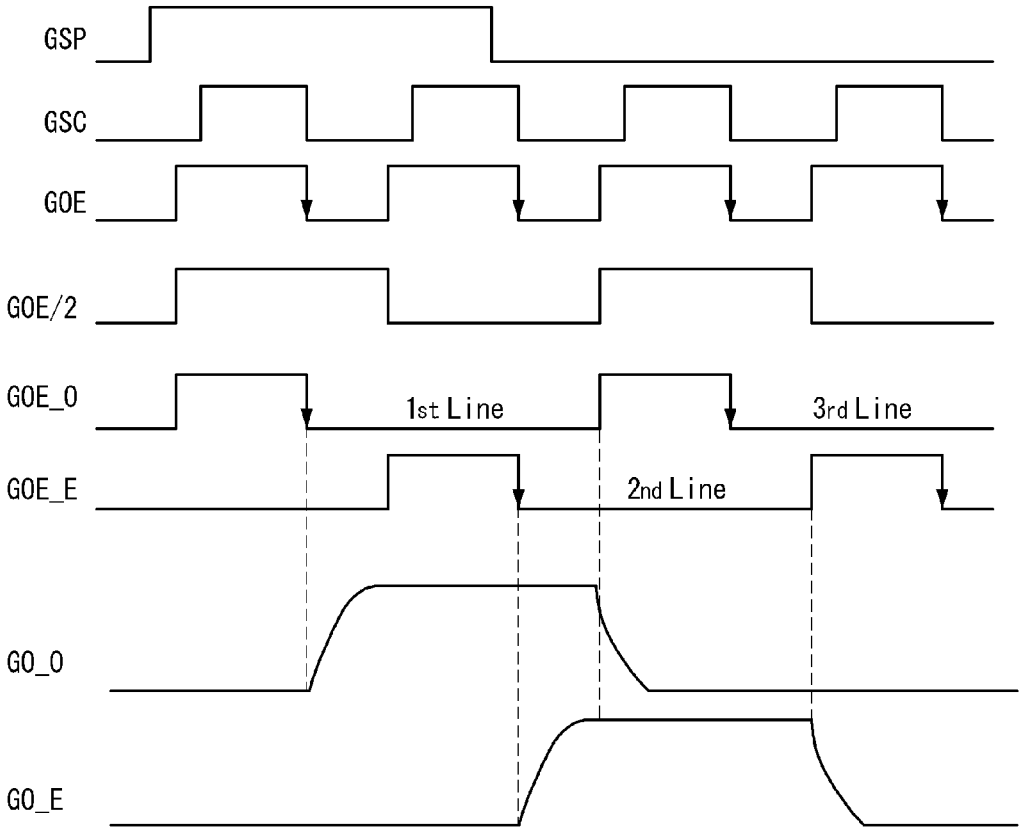
FIG. 7 is a waveform diagram showing first and second gate output enable signals and first and second gate pulses according to an example embodiment of the present invention.

As shown in FIGS. 5 to 7, the GOE division part 300 includes a 2-frequency divider circuit 301, an inverter 305, and first and second AND operators 311 and 312 implemented by AND gates.

The 2-frequency divider circuit 301 receives the gate output enable signal GOE to generate a 2-frequency divided gate output enable signal (GOE/2) having ½ the frequency of the gate output enable signal GOE.

The first AND operator 311 receives the 2-frequency divided gate output enable signal GOE/2 and the gate output enable signal GOE to output an AND operation result. That is, the first AND operator 311 outputs a high logic signal only during periods in which both of the 2-frequency divided gate output enable signal GOE/2 and the gate output enable signal GOE have a high logic level. The first gate output enable signal GOE_O, which is an output signal of the first AND operator 311, controls the output timing of the first gate pulse G_O output to the odd-numbered gate lines.

The second AND operator 312 receives an inverted 2-frequency divided gate output enable signal (GOE/2) from the inverter 305 and the gate output enable signal GOE to output an AND operation result, thereby generating the second gate output enable signal GOE_E. That is, the second AND operator 312 outputs a high logic signal only during periods in which both of the inverted 2-frequency divided gate output enable signal GOE/2 and the gate output enable signal GOE have a high logic level. The second gate output enable signal GOE_E, which is an output signal of the second AND operator 312, controls the output timing of the second gate pulse G_E output to the even-numbered gate lines.

As shown in FIGS. 5 to 7, each of the gate ICs 331 to 335 may include a GOE division part 300, a shift register 360, a level shifter 370, and third and fourth AND operators 365 and 367 implemented by AND gates.

The shift register 360 of each of the gate ICs 331 to 335 shifts a gate start pulse GSP at every rising edge of a gate shift clock GSC by using a plurality of sequentially connected flip-flops. Therefore, the shift register 360 of each of the gate ICs 331 to 335 sequentially generates outputs through the output of each of the flip-flops.

Here, the timing controller 31 supplies the gate start pulse GSP having a high logic level for a period longer than one horizontal period (H) to the gate ICs 331 to 335. For example, the gate start pulse GSP may have a high logic level for more than 1 and less than to 2 horizontal periods (H). As such, this example embodiment of the present invention can prevent a gate-off phenomenon since the high logic period of the gate start pulse GSP is longer than one horizontal period (H).

Each of the third AND operators 365 of the gate IC 331 generates an AND output of an output of the shift register 360 and a first gate output enable signal GOE_O inverted by the first inverter 361. In addition, each of the fourth AND operators 367 generates an AND output of an output of the shift register 360 and a second gate output enable signal GOE_E inverted by the second inverter 362.

When one period of the gate output enable signal GOE is one horizontal period (H), one period of the first gate output enable signal GOE_O becomes two horizontal periods (H). In addition, the first gate output enable signal GOE_O is output as a high logic signal only during periods while both of the gate output enable signal GOE and the 2-frequency divided gate output enable signal GOE/2 have a high logic level. Therefore, the high logic period of the first gate output enable signal GOE_O is determined by the period of the gate output enable signal GOE. For example, the first gate output enable signal GOE_O and the second gate output enable signal GOE_E may maintain a high logic level for a period shorter than one horizontal period (H).

The level shifter 370 receives an output of the shift register 360 when the first and second gate output enable signals GOE_O and GOE_E have a low logic level. Eventually, the low logic periods of the first and second gate output enable signals GOE_O and GOE_E result in the high logic periods of the first and second gate pulses G_O and G_E. For example, the high logic periods of the first and second gate pulses G_O and G_E may be within the range of longer than 1 and shorter than 2 horizontal periods (H).

Accordingly, the first gate output enable signal GOE_O of the example embodiment of the present invention may have a low logic level for one to two horizontal periods (H). Therefore, the first gate pulse G_O can maintain a high logic level for longer than one but shorter than two horizontal periods (H). That is, the first gate pulse G_O does not cause a gate-off phenomenon while scanning the odd-numbered gate lines.

Similarly, the second gate pulse G_E can maintain a high logic level for longer than one but shorter than two horizontal periods (H), and thus not cause a gate-off phenomenon while scanning the even-numbered gate lines.

In addition, since the first gate pulse G_O or the second gate pulse G_E according to the example embodiment of the present invention has a high logic level for a period shorter than two horizontal periods (H), the time for charging data of the previous frame can be shortened in comparison with the gate pulse in the related art device having a high logic level for two horizontal periods (H).

Figure 8:
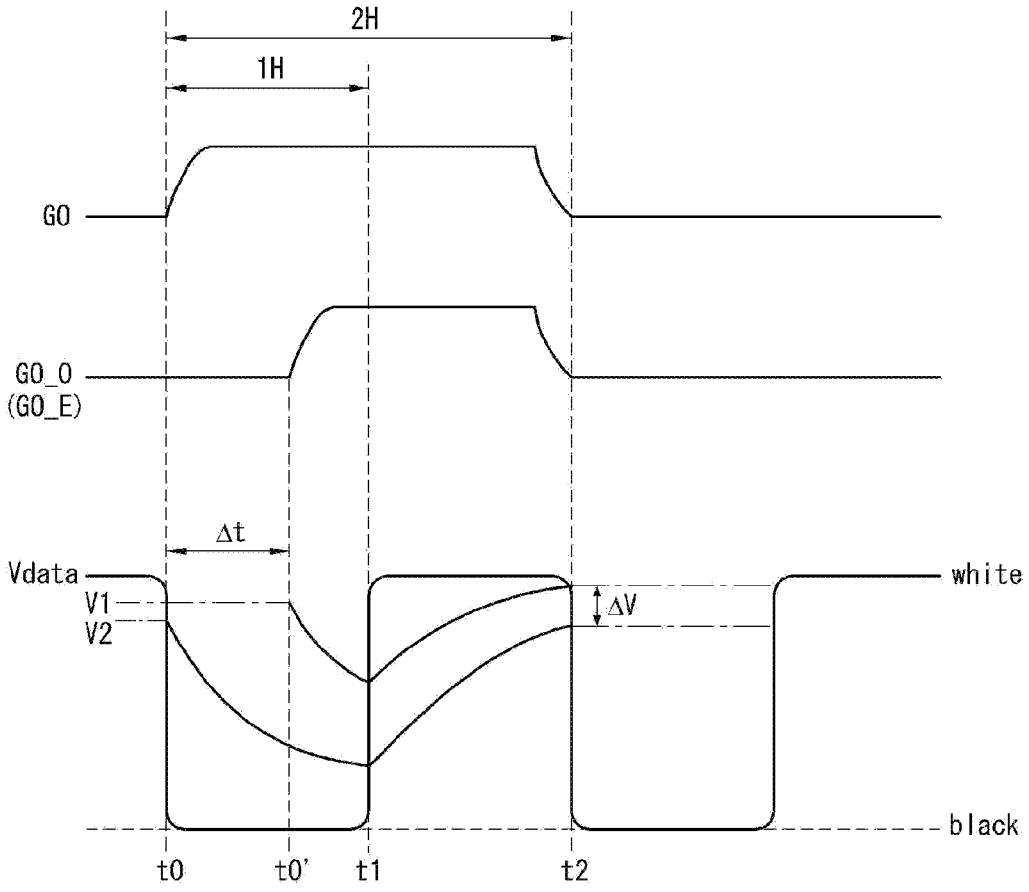
FIG. 8 is a view illustrating charging characteristics of gate pulses according to an example embodiment of the present invention.

This will be described with reference to FIG. 8 as follows. In the related art device, a gate pulse GO having a high logic level for two horizontal periods (H) pre-charges data of the previous frame during 't0' to 't1' and then charges data of the current frame during 't1' to 't2'. The data voltage difference between the previous frame and the current frame may be very large in a pattern having a large difference in brightness, for example, when black data and white data are sequentially received as shown in FIG. 8. When there is such a large difference in data voltages, because the voltage level is significantly lowered during the pre-charging period, the voltage may not be charged up to a desired voltage level for depicting white data.

In contrast, according to the example embodiment of the present invention, since the first and second gate pulses G_O and G_E maintain a high logic level during a period shorter than two horizontal periods (H), the pre-charging period is from 't0' to 't1'. That is, the first and second gate pulses G_O and G_E can decrease the pre-charging period by '$\Delta t$'. Therefore, even when a pattern having a large difference in brightness from frame to frame is received, the first and second gate pulses are less influenced by the voltage level charged by the data of the previous frame during the pre-charging period. Eventually, the first and second gate pulses G_O and G_E according to the example embodiment of the present invention can increase the charged data voltage level by '$\Delta V$' as compared with the gate pulse GO used in the related art device.

In addition, each of the gate ICs 331 to 335 may include a buffer unit 380. The buffers of the buffer unit 380 amplify the first and second gate pulses G_O and G_E received from the level shifter 370, and sequentially supply the amplified first and second gate pulses G_O and G_E to respective gate lines G1 to Gk.

Figure 9:
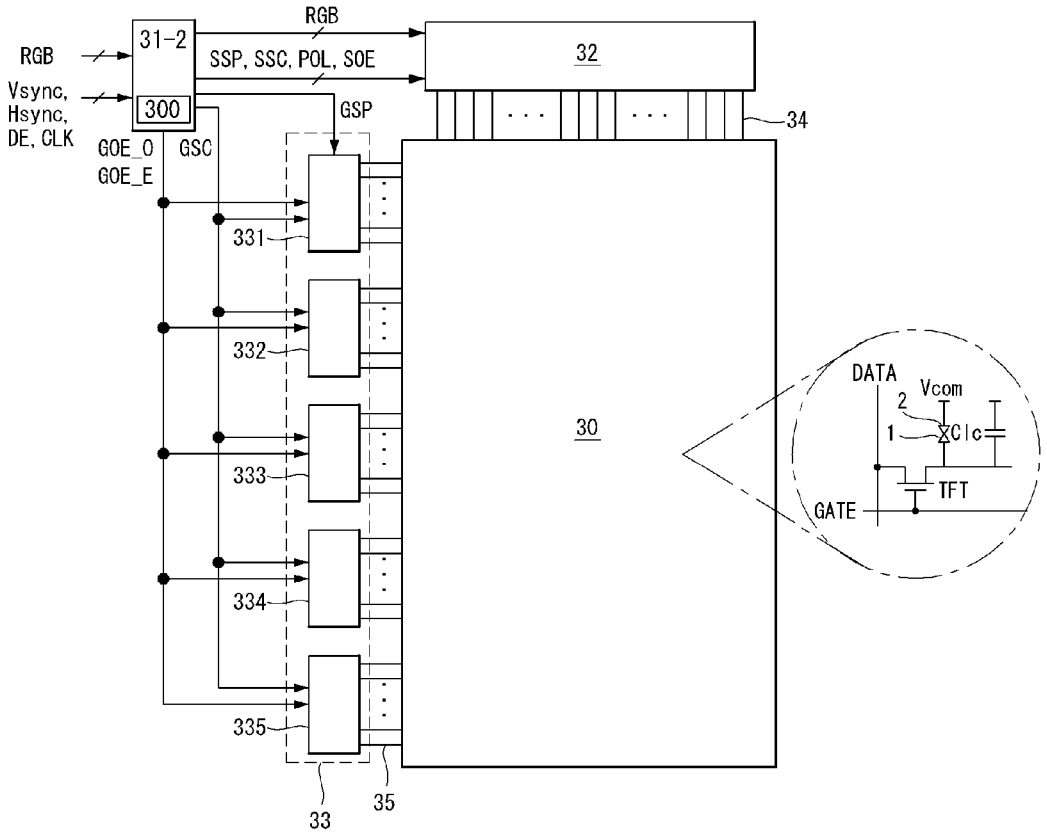
FIG. 9 is a diagram showing a liquid crystal display according to the second example embodiment of the present invention.

The above example embodiment of the present invention has the GOE division part 300 included in each of the gate ICs 331 to 335. Alternatively, however, the GOE division part 300 may be included in the timing controller 31, as shown in FIG. 9, or may be provided as a separate, standalone circuit, instead of being included in each of the gate ICs 331 to 335.

According to the present invention, the gate pulses having a high logic level for a period longer than one horizontal period (H) may be separately applied to odd-numbered gate lines and even-numbered gate lines, thereby preventing the gate-off phenomenon.

Further, according to the present invention, the charging characteristics of data voltages can be improved by setting the width of the gate pulse to be smaller than two horizontal periods.

It will be apparent to those skilled in the art that various modifications and variations can be made in the display device and driving method of the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel having a plurality of data lines and a plurality of gate lines crossing the data lines, the gate lines including a plurality of odd-numbered gate lines and a plurality of even-numbered gate lines;

a timing controller to generate a gate output enable signal;

a gate output enable signal division circuit to extract odd-numbered high logic periods of the gate output enable signal to output a first gate output enable signal and to extract even-numbered high logic periods of the gate output enable signal to output a second gate output enable signal; and a gate driver to supply a first gate pulse to at least one of the odd-numbered gate lines in response to the first gate output enable signal and a second gate pulse to at least one of the even-numbered gate lines in response to the second gate output enable signal, wherein the timing controller is also configured to generate a gate shift clock signal, and wherein the first and second gate pulses overlap each other for a period shorter than one cycle of the gate shift clock signal.

2. The display device of claim 1, wherein at least one of the first and second gate pulses has a width that is longer than one cycle of the gate shift clock signal but shorter than two cycles of the gate shift clock signal.

3. The display device of claim 1, wherein the gate output enable signal division circuit includes:

a 2-frequency divider circuit to divide the frequency of the gate output enable signal by 2and to output a 2-frequency divided gate output enable signal;

a first inverter to invert the phase of the 2-frequency divided gate output enable signal;

a first AND operator to receive the 2-frequency divided gate output enable signal and the gate output enable signal as inputs and to output the first gate output enable signal; and a second AND operator to receive the inverted 2-frequency divided gate output enable signal and the gate output enable signal as inputs and to output the second gate output enable signal.

4. The display device of claim 1, wherein the gate driver includes:

a shift register to receive a gate start pulse and the gate shift clock signal from the timing controller, and to output a first output and a second output;

a second inverter to invert the phase of the first gate output enable signal and to output the inverted first gate output enable signal;

a third inverter to invert the phase of the second gate output enable signal and to output the inverted second gate output enable signal;

a third AND operator to receive the first output from the shift register and the inverted first gate output enable signal and to generate a first AND output;

a fourth AND gate to receive the second output from the shift register and the inverted second gate output enable signal and to generate a second AND output; and a level shifter to generate the first gate pulse based on the first AND output and the second gate pulse based on the second AND output.

5. The display device of claim 4, wherein the gate driver further includes a buffer unit to amplify the first and second gate pulses, and to supply the amplified first gate pulse to the at least one of the odd-numbered gate lines and the amplified second gate pulse to the at least one of the even-numbered gate lines.

6. The display device of claim 1, wherein the gate output enable signal division circuit is included in the gate driver.

7. The display device of claim 1, wherein the gate output enable signal division circuit is included in the timing controller.

8. A display device, comprising:

a display panel having a plurality of data lines and a plurality of gate lines crossing the data lines, the gate lines including a plurality of odd-numbered gate lines and a plurality of even-numbered gate lines;

a timing controller to generate a gate output enable signal and a gate shift clock signal;

a gate output enable signal division circuit to generate a first gate output enable signal and a second gate output enable signal based on the gate output enable signal; and a gate IC to supply a first gate pulse to at least one of the odd-numbered gate lines based on the first gate output enable signal and a second gate pulse to at least one of the even-numbered gate lines based on the second gate output enable signal, wherein at least one of the first and second gate pulses has a width longer than one cycle of the gate shift clock signal and shorter than two cycles of the gate shift clock signal, and wherein the first and second gate pulses overlap each other for a period shorter than one cycle of the gate shift clock signal.

9. The display device of claim 8, wherein the timing controller is also configured to generate a gate start pulse having a width longer than one cycle of the gate shift clock and shorter than two cycles of the gate shift clock signal, and wherein the gate IC is configured to receive the gate start pulse and supply the first and second gate pulses based on the gate start pulse.

10. The display device of claim 8, wherein the gate output enable signal division circuit includes:

a 2-frequency divider circuit to divide the frequency of the gate output enable signal by 2and to generate a 2-frequency divided gate output enable signal;

a first inverter to invert the phase of the 2-frequency divided gate output enable signal;

a first AND operator to receive the 2-frequency divided gate output enable signal and the gate output enable signal as inputs and to output the first gate output enable signal; and a second AND operator to receive the inverted 2-frequency divided gate output enable signal and the gate output enable signal as inputs and to output the second gate output enable signal.

11. The display device of claim 8, wherein the gate IC includes:

a shift register to receive a gate start pulse and the gate shift clock signal from the timing controller, and to output a first output and a second output;

a second inverter to invert the phase of the first gate output enable signal and to output the inverted first gate output enable signal;

a third inverter to invert the phase of the second gate output enable signal and to output the inverted second gate output enable signal;

a third AND operator to receive the first output from the shift register and the inverted first gate output enable signal and to generate a first AND output;

a fourth AND gate to receive the second output from the shift register and the inverted second gate output enable signal and to generate a second AND output; and a level shifter to generate the first gate pulse based on the first AND output and the second gate pulse based on the second AND output.

12. The display device of claim 11, wherein the gate IC further includes a buffer unit to amplify the first and second gate pulses, and to supply the amplified first gate pulse to the at least one of the odd-numbered gate lines and the amplified second gate pulse to the at least one of the even-numbered gate lines.

13. The display device of claim 8, wherein the gate output enable signal division circuit is included in the gate IC.

14. The display device of claim 8, wherein the gate output enable signal division circuit is included in the timing controller.

15. A method for driving a display device with a display panel having a plurality of data lines and a plurality of gate lines crossing the data lines, the gate lines including a plurality of odd-numbered gate lines and a plurality of even-numbered gate lines, the method comprising:

receiving a gate output enable signal;

generating a first gate output enable signal and a second gate output enable signal based on the gate output enable signal, wherein the first and second gate output enable signals each have a lower frequency than the gate output enable signal;

supplying a first gate pulse to at least one of the odd-numbered gate lines based on the first gate output enable signal; and supplying a second gate pulse to at least one of the even-numbered gate lines based on the second gate output enable signal.

16. The method of claim 15, further comprising receiving a gate start pulse and a gate shift clock signal, wherein the gate start pulse has a width longer than one cycle of the gate shift clock and shorter than two cycles of the gate shift clock signal.

17. The method of claim 15, further comprising receiving a gate shift clock signal, wherein at least one of the first and second gate pulses has a width longer than one cycle of the gate shift clock and shorter than two cycles of the gate shift clock signal.

18. The method of claim 15, further comprising receiving a gate shift clock signal, wherein the first and second gate pulses overlap each other for a period shorter than one cycle of the gate shift clock signal.

19. The method of claim 15, wherein the generating of the first and second gate output enable signals includes:

extracting odd-numbered high logic periods of the gate output enable signal to generate the first gate output enable signal; and extracting even-numbered high logic periods of the gate output enable signal to generate the second gate output enable signal.

20. The method of claim 15, wherein the generating of the first and second gate output enable signals includes:

dividing the frequency of the gate output enable signal by 2 to generate a 2-frequency divided gate output enable signal;

inverting the 2-frequency divided gate output enable signal to generate an inverted 2-frequency divided gate output enable signal;

performing an AND operation on the 2-frequency divided gate output enable signal and the gate output enable signal to generate the first gate output enable signal; and performing an AND operation on the inverted 2-frequency divided gate output enable signal and the gate output enable signal to generate the second gate output enable signal.

* * * * *